US005921427A

United States Patent [19]

Giannone et al.

[11] Patent Number: 5,921,427

[45] Date of Patent: Jul. 13, 1999

[54] TRASH DISCRIMINATOR DEVICE

[76] Inventors: Benny Giannone, 151 Tullamore Rd., Garden City; Salvatore Giannone, 193 Beach 127th St., Rockaway, both of N.Y. 11694

[21] Appl. No.: 08/925,396

[22] Filed: Sep. 8, 1997

[51] Int. Cl.[6] ..... B65D 25/16; B65D 90/04

[52] U.S. Cl. ..... 220/495.06; 220/694; 220/729; 248/99; 248/101; 248/213.2

[58] Field of Search ..... 220/404, 694, 220/729, 730, 495.08; 248/101, 95, 231.81, 213.2, 99

[56] References Cited

U.S. PATENT DOCUMENTS

| | | | |
|---|---|---|---|
| 1,643,407 | 9/1927 | Florence | 220/495.11 X |
| 2,960,256 | 11/1960 | Feibelman | 220/729 |
| 4,426,015 | 1/1984 | Preston et al. | 220/495.08 X |
| 4,878,590 | 11/1989 | Porter | 220/890 |
| 5,190,183 | 3/1993 | McNaughton et al. | 248/95 X |
| 5,193,713 | 3/1993 | Greathouse et al. | 220/495.08 X |
| 5,381,918 | 1/1995 | Dahl | 220/694 X |
| 5,577,632 | 11/1996 | Blanchette et al. | 220/730 |

*Primary Examiner*—Allan N. Shoap
*Assistant Examiner*—Joe Merek
*Attorney, Agent, or Firm*—Michael I. Kroll

[57] ABSTRACT

A trash discriminator device (10) for a container (12) having an open top edge (14) which holds a plastic bag (16) therein, with an upper portion (18) of the plastic bag (16) folded over the open top edge (14) of the container (12). The device (10) comprises a barrier (26) placed over the open top edge (14) of the container (12) to allow trash to enter the plastic bag (16), while preventing a tray (24) to be deposited into the plastic bag (16). A structure (28) is for attaching in a removable manner the barrier (26) onto the open top edge (14) of the container (12) on the folded over upper portion (18) of the plastic bag (16), so as to hold the plastic bag (16) in place and stop the plastic bag (16) from sliding down into the container (12).

2 Claims, 10 Drawing Sheets

TRASH DISCRIMINATOR DEVICE

BACKGROUND OF THE INVENTION

1. Field of the Invention

The instant invention relates generally to screening systems and more specifically it relates to a trash discriminator device. The trash discriminator device is connected over a plastic bag in a container, so as to allow regular trash to enter the plastic bag, while preventing other large objects, such as trays, to be deposited therein.

2. Description of the Prior Art

Numerous screening systems have been provided in prior art that are adapted to sift out fine particles, such as sand, gravel or coal by means of utilizing sieves. While these units may be suitable for the particular purpose to which they address, they would not be as suitable for the purposes of the present invention as heretofore described.

SUMMARY OF THE INVENTION

A primary object of the present invention is to provide a trash discriminator device that will overcome the shortcomings of the prior art devices.

Another object is to provide a trash discriminator device that contains a barrier placed over a plastic bag in a container, so that the barrier will allow regular trash to enter the plastic bag and prevent other large objects, such as trays, to be deposited within the plastic bag.

An additional object is to provide a trash discriminator device in which a clamping member on the barrier will hold an upper portion of the plastic bag folded over an open top edge of the container in place and to prevent the plastic bag from sliding down into the container.

A further object is to provide a trash discriminator device that is simple and easy to use.

A still further object is to provide a trash discriminator device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
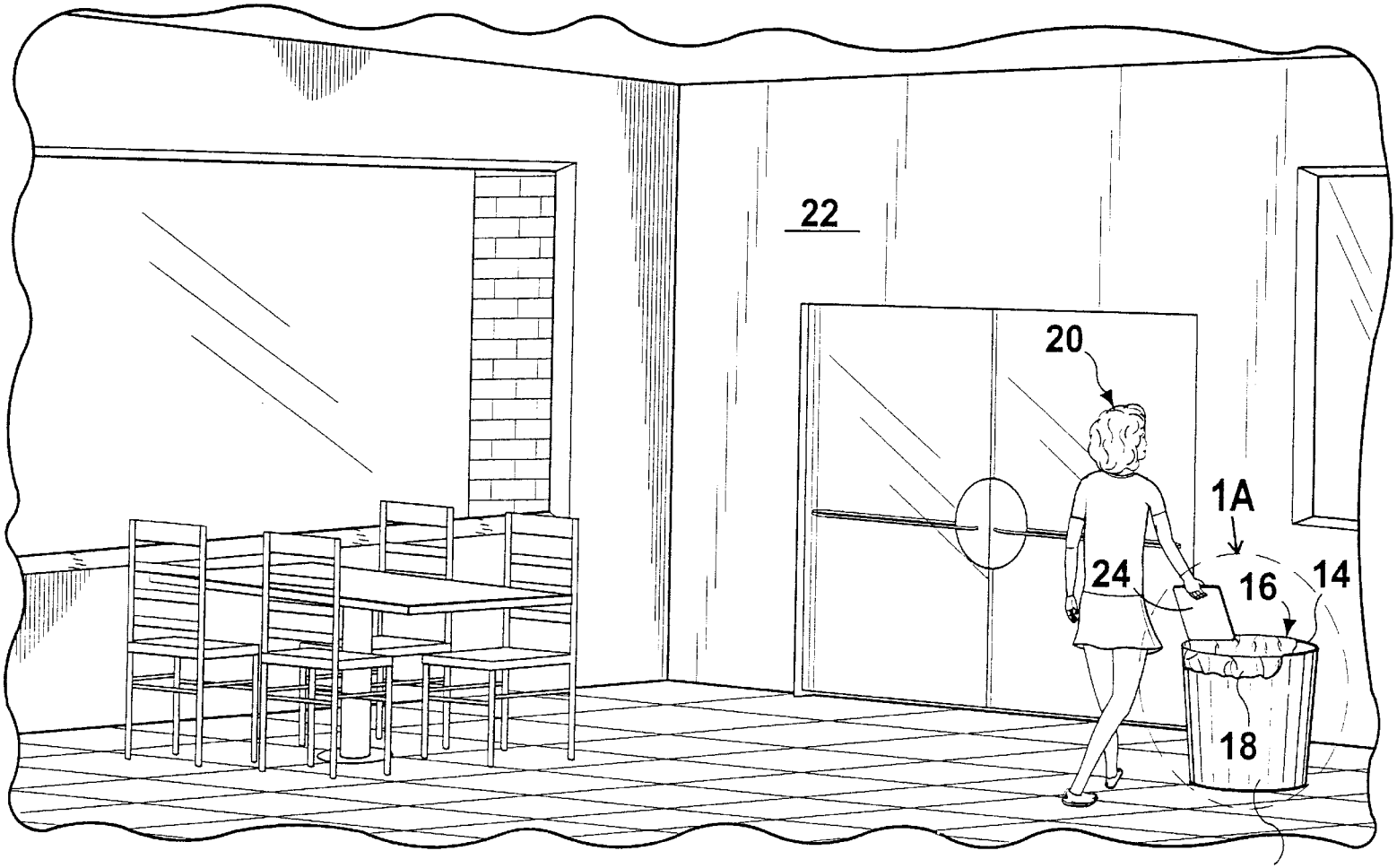
FIG 1 ( PRIOR ART )
FIG. 1 is a perspective view of a typical fast food restaurant, showing the prior art in use.

Turning now descriptively to the drawings, in which similar reference characters denote similar elements throughout the several views, FIGS. 2 through 9B illustrate a trash discriminator device 10 of the present invention. With regard to the reference numerals used, the following numbering is used throughout the various drawing figures.

10 trash discriminator device
12 container
14 open top edge of 12
16 plastic bag
18 upper portion of 16
20 person
22 fast food restaurant
24 tray
26 barrier of 10
28 attaching structure of 10
30 grate for 26
32 ring of 30
34 arm of 30
36 C-shaped clip of 28
38 annular clamp for 28
40 small ring of 30
42 large ring of 30
44 arm of 30
46 crisscrossing bars of 30
48 strong durable material for 26 and 28

Figure 1A:
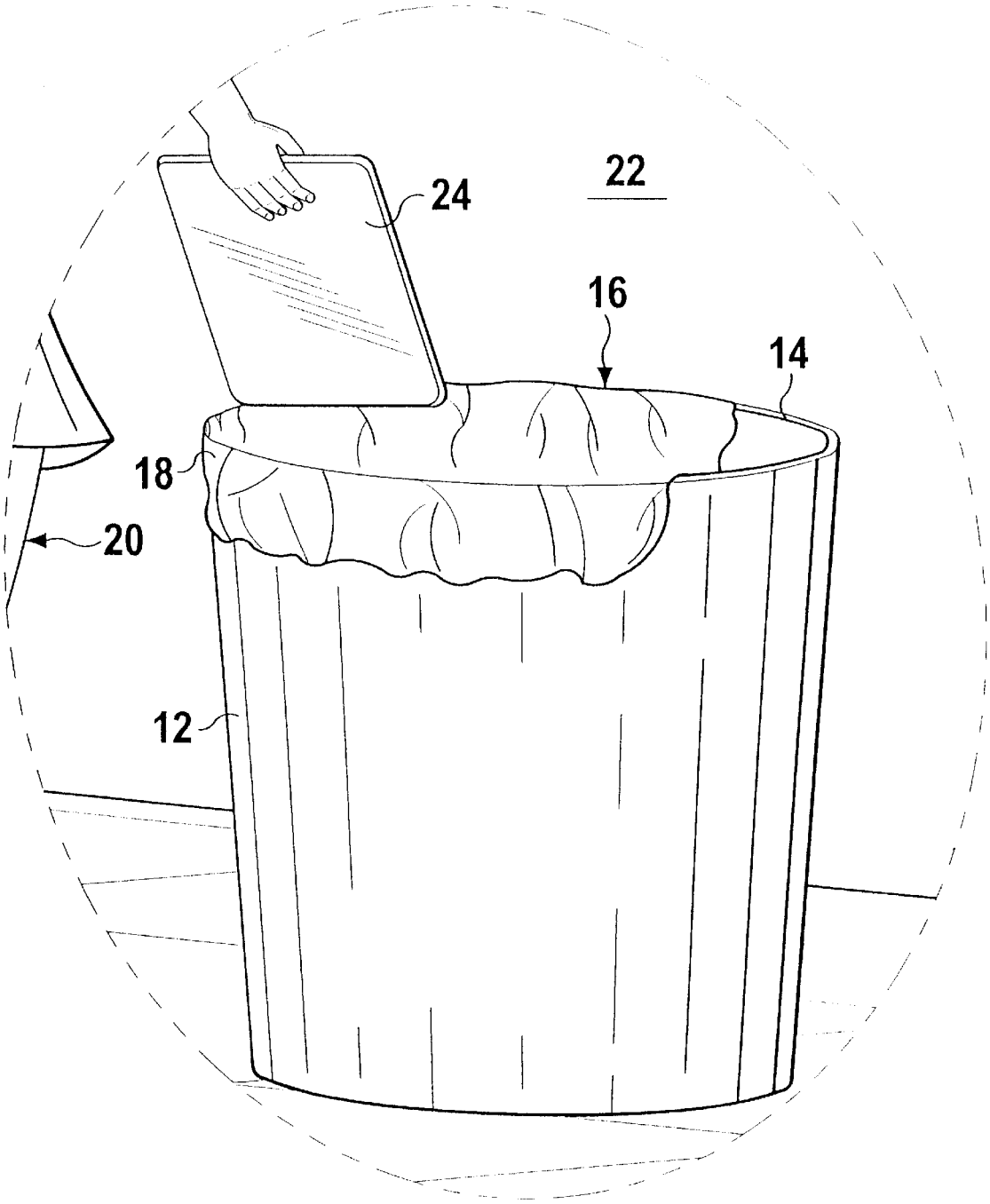
FIG 1A ( PRIOR ART )
FIG. 1A is an enlarged perspective view of the prior art in use as indicated by arrow 1A in FIG. 1.

FIGS. 1 and 1A show the prior art being a container 12 having an open top edge 14 which holds a plastic bag 16 therein, with an upper portion 18 of the plastic bag 16 folded over the open top edge 14 of the container 12 which is sliding down into the container 12. A person 20 in a fast food restaurant 22 is depositing a tray 24 into the plastic bag 16.

The trash discriminator device 10 comprises a barrier 26 placed over the open top edge 14 of the container 12 to allow trash to enter the plastic bag 16, while preventing the tray 24 to be deposited into the plastic bag 16. A structure 28 is for attaching in a removable manner the barrier 26 onto the open top edge 14 of the container 12 on the folded over upper portion 18 of the plastic bag 16, so as to hold the plastic bag 16 in place and stop the plastic bag 16 from sliding down into the container 12. The barrier 26 is a grate 30, sized to fit over the open top edge 14 of the container 12.

The grate 30, as shown in FIGS. 2 to 7B, includes a ring 32 and a plurality of arms 34. Each arm 34 is affixed at a first end to the ring 32, to radially extend outwardly therefrom.

Figure 2:
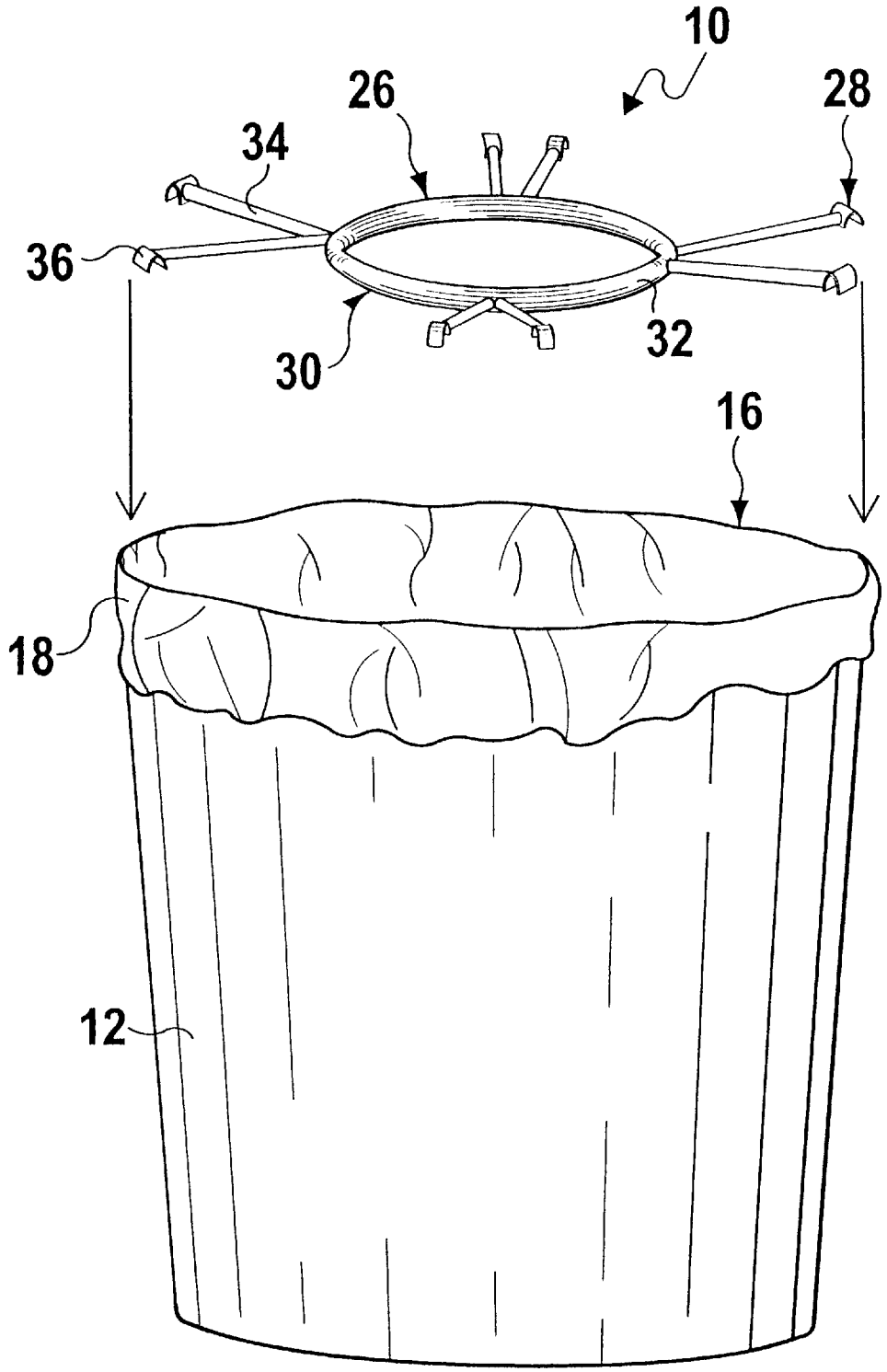
FIG. 2 is a perspective view, showing a first embodiment of the instant invention ready to be put in place.
Figure 3:
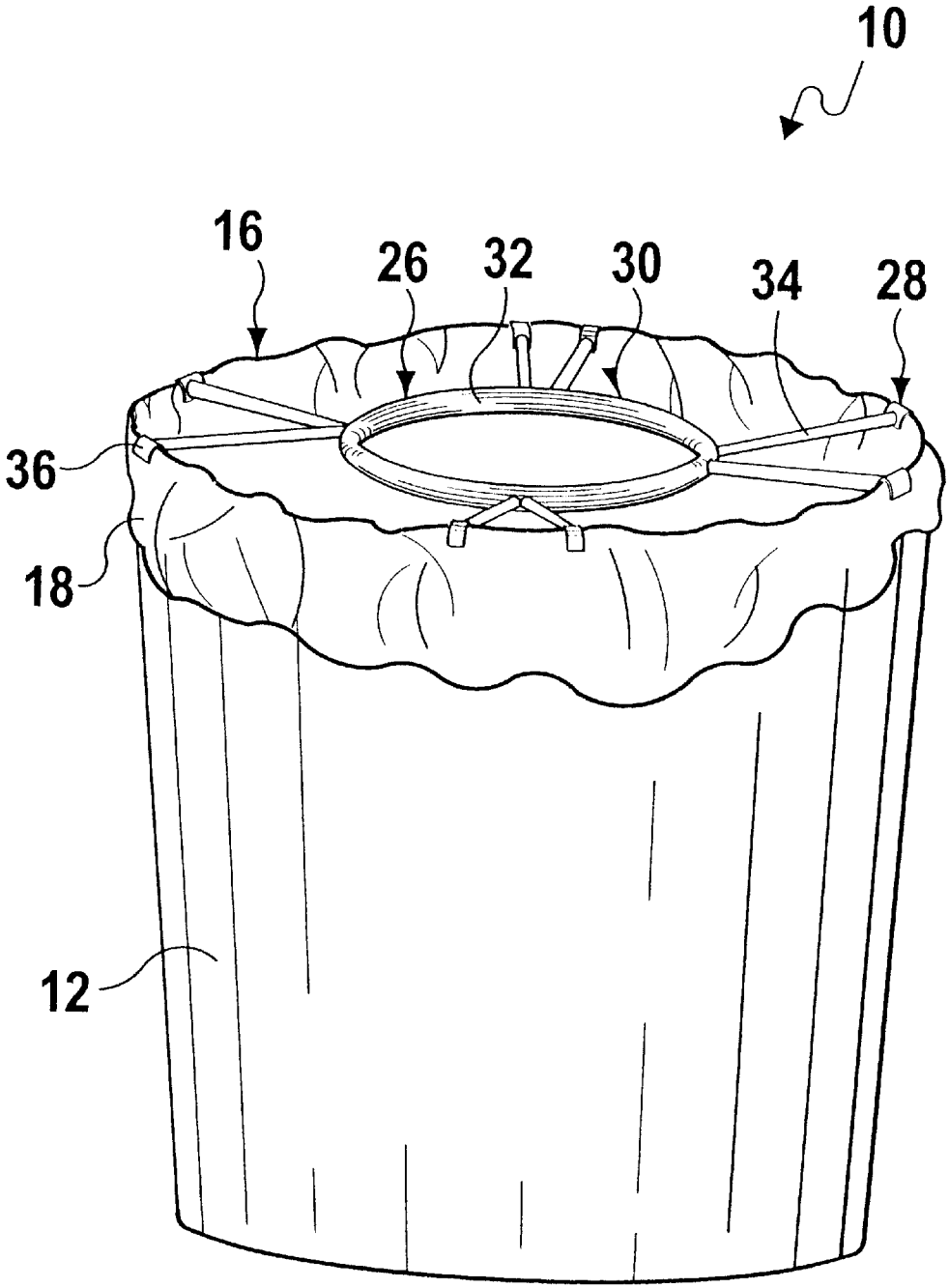
FIG. 3 is a perspective view similar to FIG. 2, showing the first embodiment in place.
Figure 4:
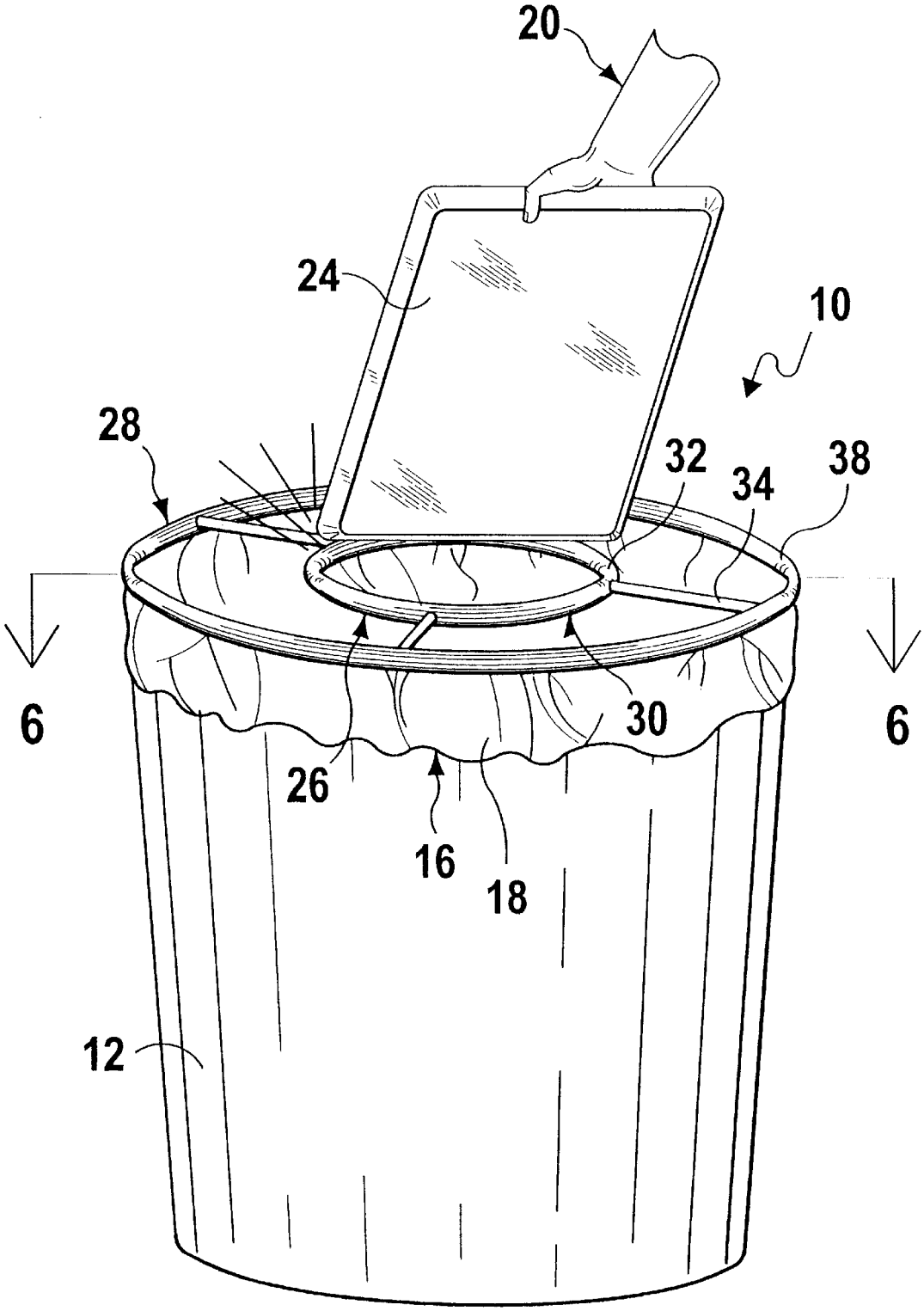
FIG. 4 is a perspective view similar to FIG. 3, showing a second embodiment of the instant invention in place and in use.
Figure 5:
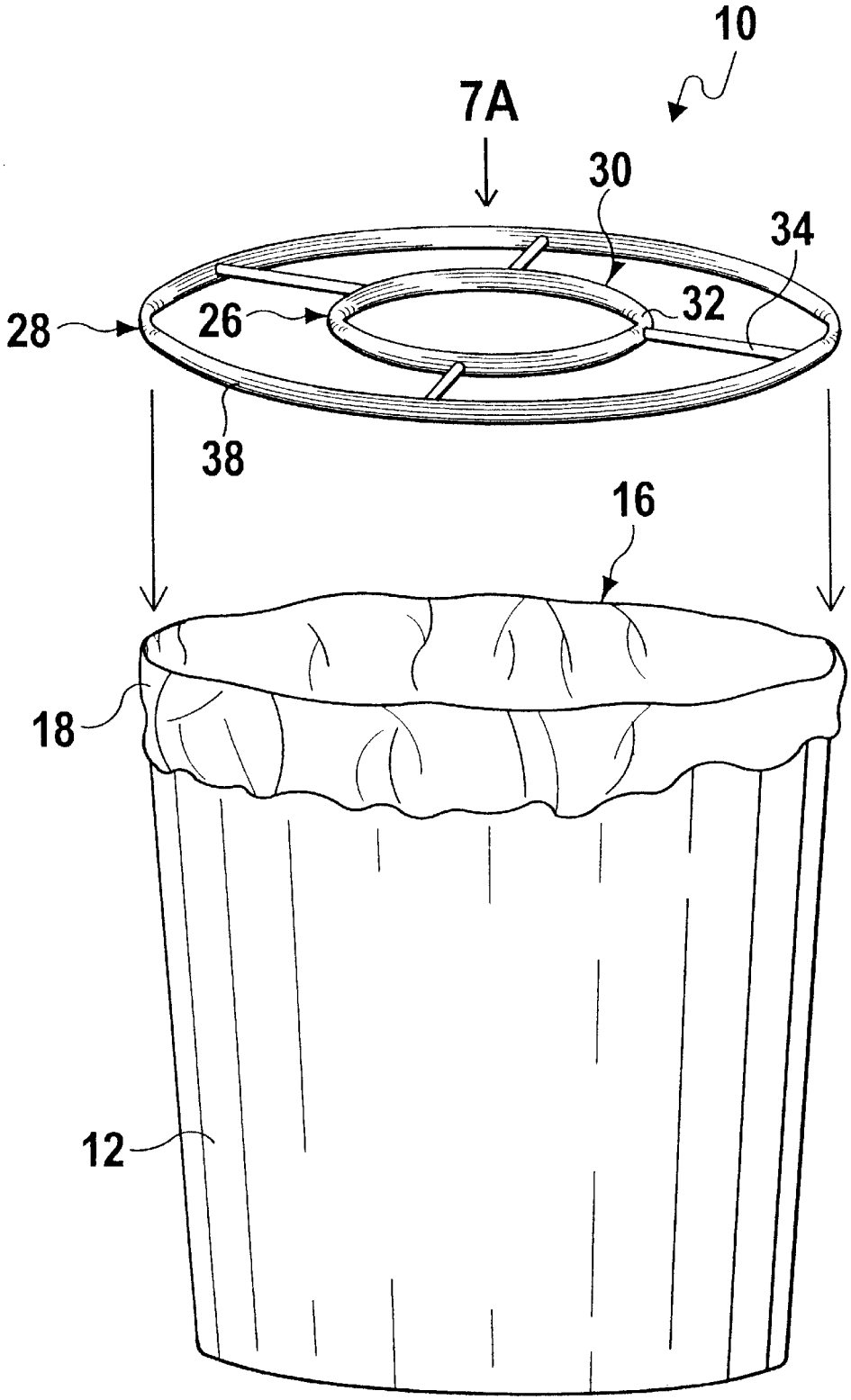
FIG. 5 is a perspective view similar to FIG. 2, showing the second embodiment ready to be put in place.

The attaching structure 28 in FIGS. 2 and 3, consists of a plurality of C-shaped clips 36. Each clip 36 is affixed to a second end of each arm 34, so that the clips 36 can engage with the open top edge 14 of the container 12 and onto the folded over upper portion 18 of the plastic bag 16. The attaching structure 28 in FIGS. 4 to 7B, comprises an annular clamp 38 affixed to a second end of each of the arms 34. The annular clamp 38 being concentric with the ring 32 can engage with the open top edge 14 of the container 12 and onto the folded over upper portion 18 of the plastic bag 16, since the open top edge of the container 14 is of the same circular size as the annular clamp 38.

Figure 8A:
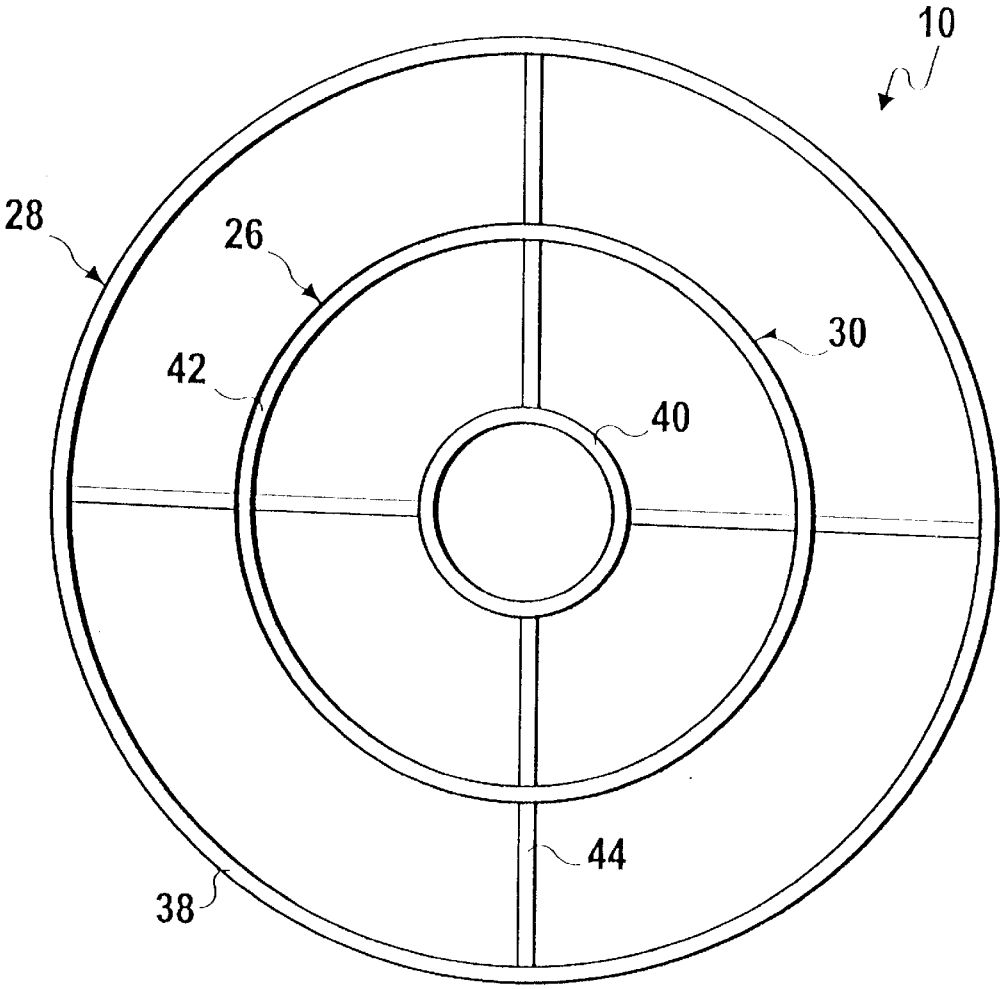
FIG. 8A is a top plan view of a third embodiment of the instant invention.
Figure 8B:
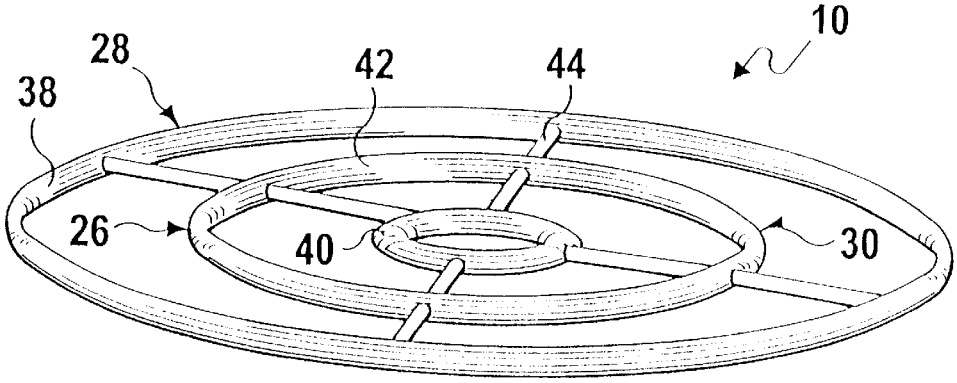
FIG. 8B is a top perspective view of the third embodiment.

The grate 30 in FIGS. 8A and 8B include a small ring 40 and a large ring 42 concentric with the small ring 40. A plurality of arms 44 are provided. Each arm 44 is affixed at a first end to the small ring 40, to radially extend outwardly therefrom through the large ring 42. The annular clamp 38 is affixed to a second end of each of the arms 44. The annular clamp 38 being concentric with the small ring 40 and the large ring 42 can engage with the open top edge 14 of the container 12 and onto the folded over upper portion 18 of the plastic bag 16, since the open top edge 14 of the container 12 is of the same circular size as the annular clamp 38.

Figure 9A:
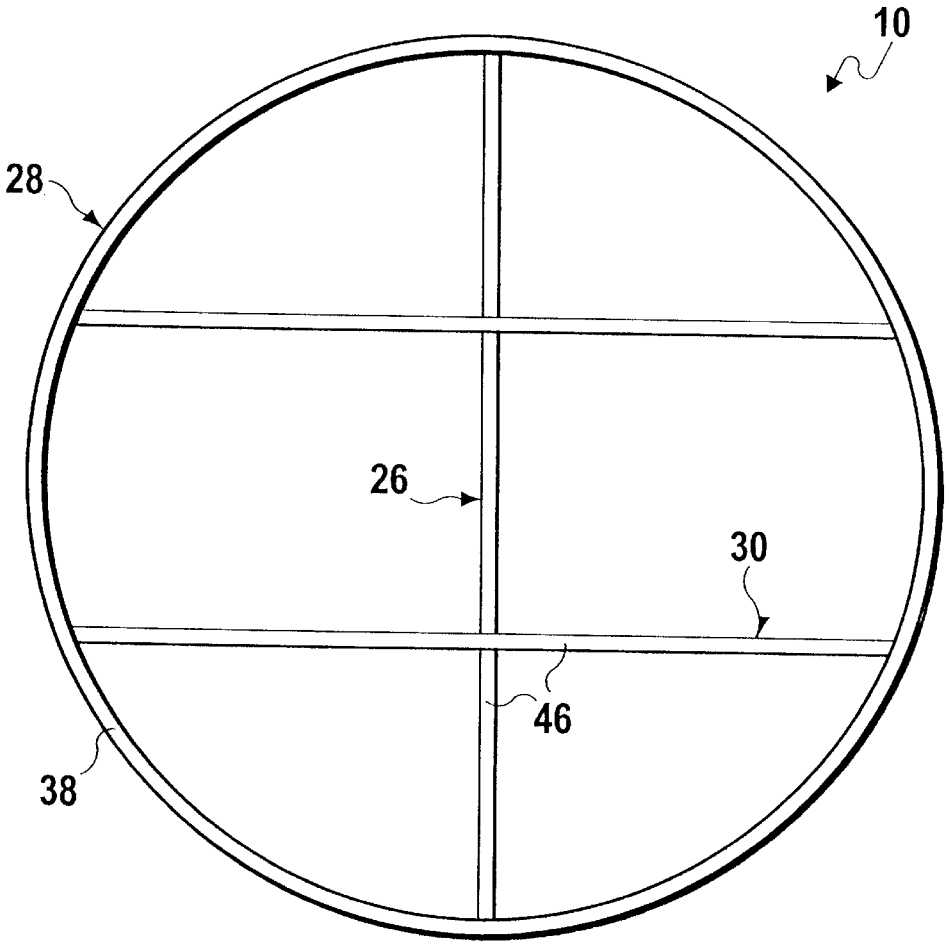
FIG. 9A is a top plan view of a fourth embodiment of the instant invention.
Figure 9B:
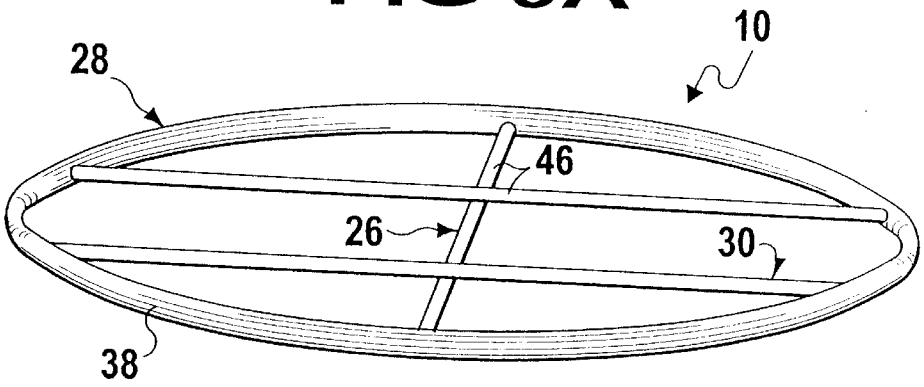
FIG. 9B is a top perspective view of the fourth embodiment.

The grate 30 in FIGS. 9A and 9B, consists of a plurality of crisscrossing bars 46. Opposite ends of the crisscrossing bars 46 are affixed to the annular clamp 38. The annular clamp 38 can engage with the open top edge 14 of the container 12 and onto the folded over upper portion 18 of the plastic bag 16, since the open top edge of the container 12 is of the same circular size as the annular clamp 38.

Figure 6:
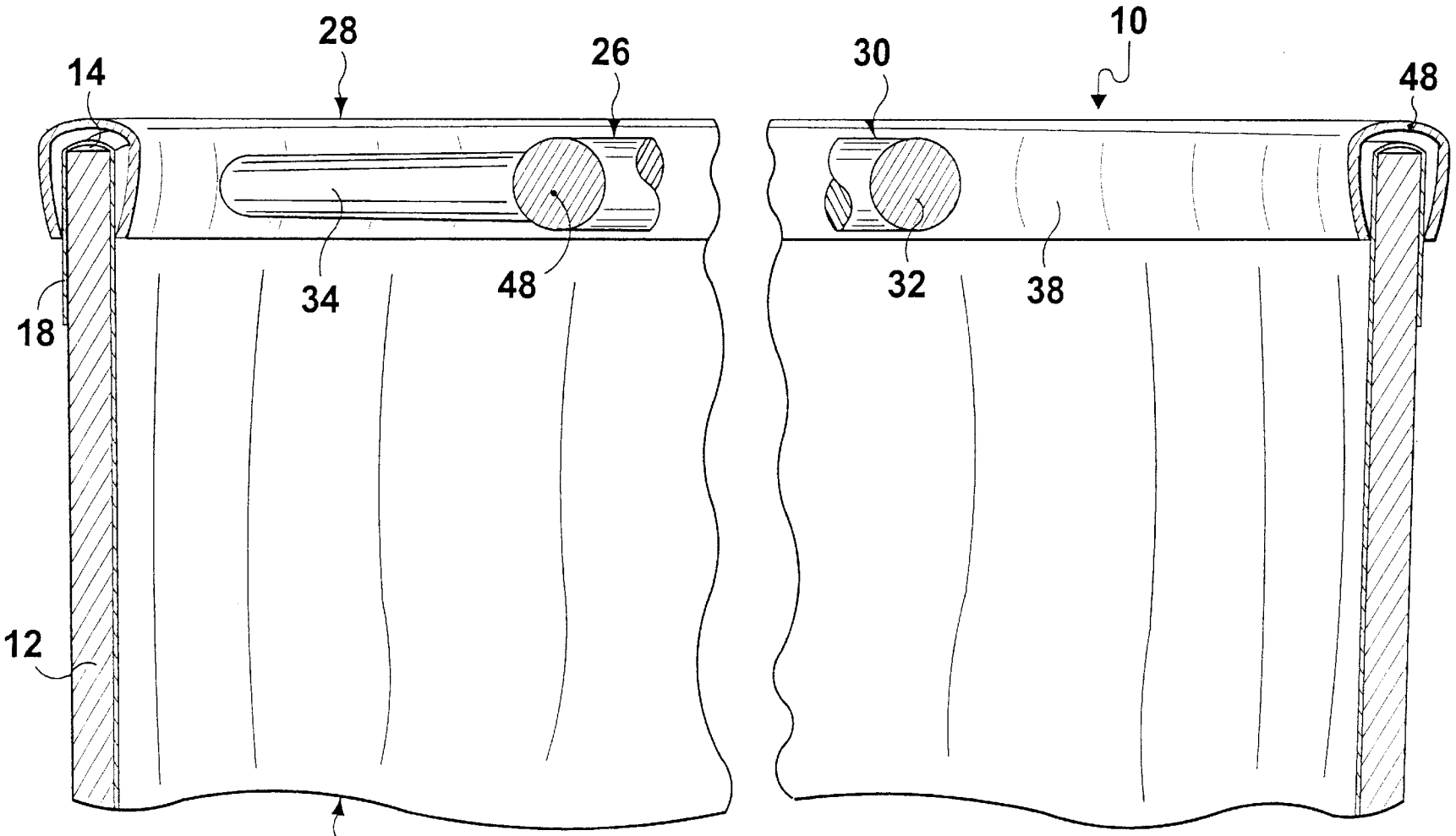
FIG. 6 is an enlarged cross sectional view taken along line 6—6 in FIG. 4.
Figure 7A:
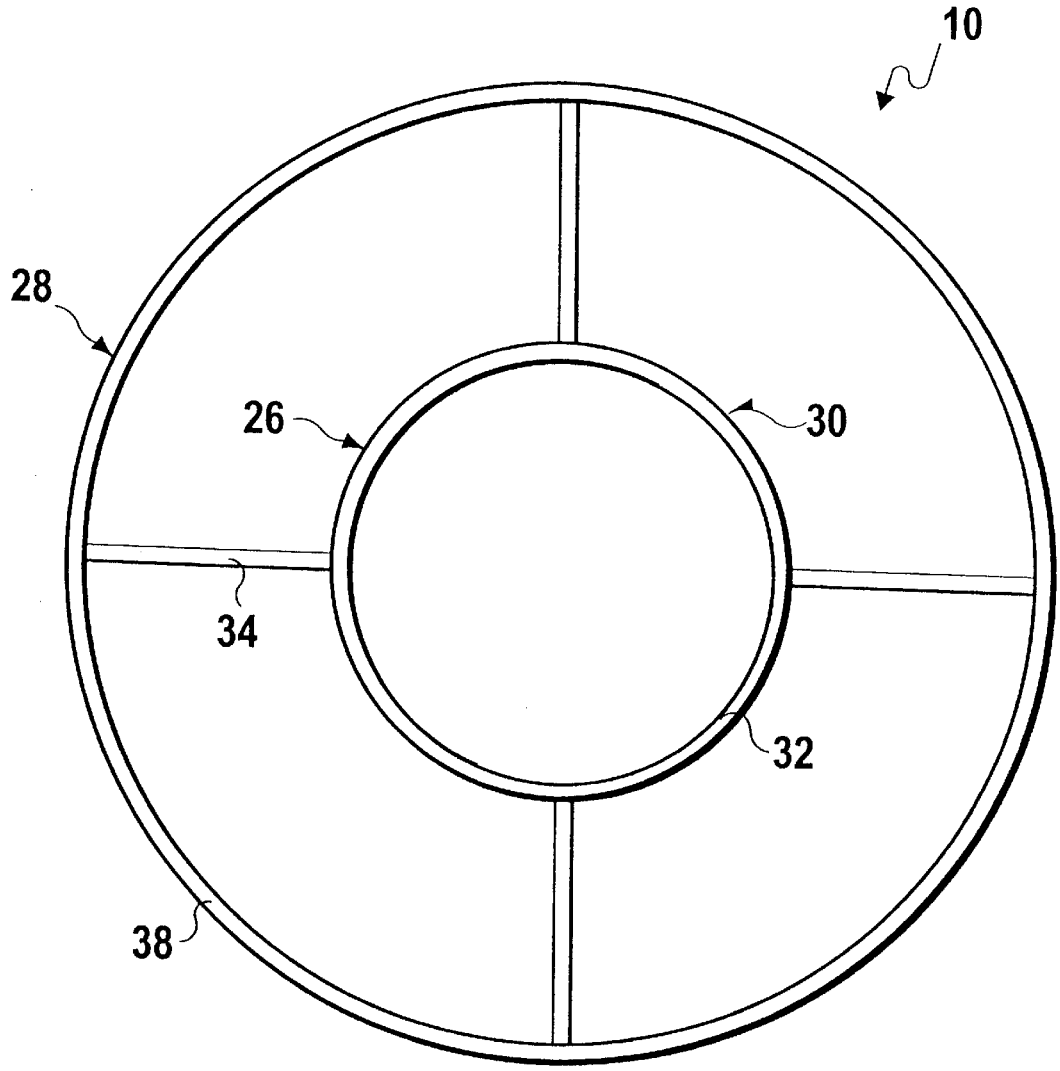
FIG. 7A is a top plan view of the second embodiment per se, taken in the direction of arrow 7A in FIG. 5.
Figure 7B:
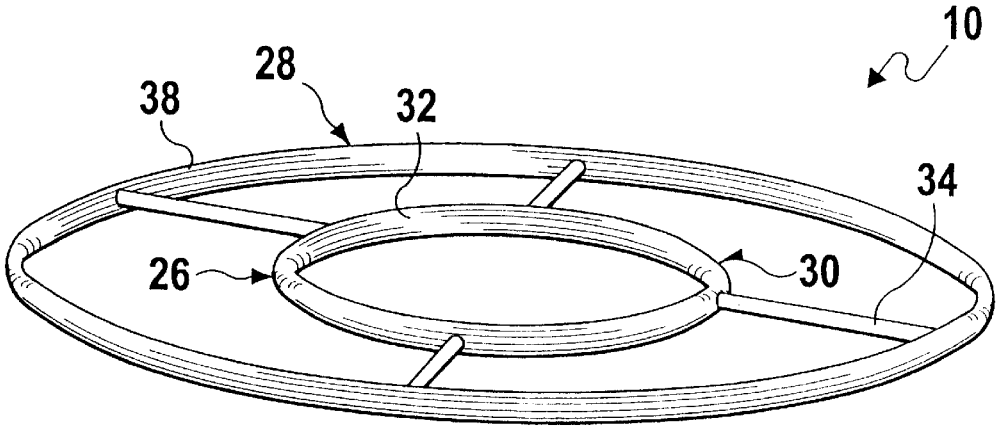
FIG. 7B is a top perspective view of the second embodiment.

The barrier 26 is fabricated out of a strong durable material 48. The attaching structure 28 is also fabricated out of the strong durable material 48, which can be metal as shown in FIG. 6 or plastic.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A trash discriminator device comprising, in combination, a container having an open top edge, a plastic bag with an upper portion of the plastic bag folded over the open top edge of the container, a tray carrying waste to be deposited into said plastic bag, and means for preventing said tray from being deposited into said plastic bag along with said trash comprising a barrier placed over the opening into said plastic bag folded over the open top edge of the container, said barrier comprising a grate having a hollow ring in the center to permit unrestricted entry of trash into said plastic bag through said ring while blocking said tray and a plurality of radially extending arms, each of said arms being fixed at a proximate end to said ring and having a free distal end, a C-shaped clip mounted on the distal end of each of said arms engaged with the top edge of said container over said plastic bag to hold said grate in place while being readily removable.

2. A trash discriminator device as recited in claim 1, wherein said barrier is fabricated out of a strong durable material.

* * * * *